US011769643B2

(12) United States Patent
Gandhi et al.

(10) Patent No.: US 11,769,643 B2
(45) Date of Patent: Sep. 26, 2023

(54) UNDERWATER DEVICE WITH ROTARY SWITCH AND RELATED SWITCH ASSEMBLY AND METHOD

(71) Applicant: Eagle Technology, LLC, Melbourne, FL (US)

(72) Inventors: Abhi Gandhi, Ocoee, FL (US); Brian Charles Strom, Melbourne Beach, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 17/445,211

(22) Filed: Aug. 17, 2021

(65) Prior Publication Data

US 2023/0057646 A1 Feb. 23, 2023

(51) Int. Cl.
*H01H 36/00* (2006.01)
*H01H 9/04* (2006.01)

(52) U.S. Cl.
CPC ..... *H01H 36/00* (2013.01); *H01H 9/04* (2013.01)

(58) Field of Classification Search
CPC ..... H01H 36/00; H01H 9/04
See application file for complete search history.

(56) References Cited

U.S. PATENT DOCUMENTS 2,288,583 A 6/1942 Leathers
3,273,091 A 9/1966 Wales, Jr.
3,317,870 A * 5/1967 Bear ..... H01B 17/308 335/207
3,597,714 A 8/1971 Visconti Brebbia et al.
3,660,789 A 5/1972 Weisenburger
4,199,741 A 4/1980 Serrus Paulet
5,694,621 A * 12/1997 Dowe ..... G03B 17/08 396/25
6,452,119 B1 9/2002 Gessner
6,762,662 B2 * 7/2004 Lee ..... H01H 36/0073 335/2
7,755,461 B1 * 7/2010 Preaux ..... H01H 36/0006 335/207

(Continued)

FOREIGN PATENT DOCUMENTS

WO WO2011020842 2/2011

OTHER PUBLICATIONS

Hydracon Company, Inc. "Safety Switch, Rotary" 1811-100: Aug. 16, 2001.

*Primary Examiner* — Bernard Rojas
(74) *Attorney, Agent, or Firm* — ALLEN, DYER, DOPPELT, + GILCHRIST, P.A. Attorneys at Law

(57) ABSTRACT

An underwater device may include a waterproof housing defining a dry cavity and having a nonferrous switch interface wall. The underwater device may include a rotary switch within the dry cavity and including a switch body, and a switch shaft extending outwardly from the switch body. The underwater device may include a first magnetic body within the dry cavity and coupled between the switch shaft and the nonferrous switch interface wall, and a second magnetic body external from the waterproof housing and adjacent the nonferrous switch interface wall in alignment with the first magnetic body so that rotation of the second magnetic body rotates the switch shaft. Each of the first magnetic body and the second magnetic body may include a permanent magnet.

20 Claims, 7 Drawing Sheets

(56) References Cited

U.S. PATENT DOCUMENTS

| | | | | |
|---|---|---|---|---|
| 9,338,864 | B2 | 5/2016 | Bosua et al. | |
| 9,355,800 | B2 * | 5/2016 | Henderson | H01H 36/00 |
| 9,754,739 | B2 * | 9/2017 | Honda | H01H 9/042 |
| 10,312,908 | B2 * | 6/2019 | Freer | H03K 17/97 |
| 10,372,021 | B2 * | 8/2019 | Lenzo | H04N 23/51 |
| 2005/0168567 | A1 * | 8/2005 | Boon | H01H 36/0073 348/25 |
| 2020/0154912 | A1 | 5/2020 | Del Balso | |
| 2021/0175034 | A1 * | 6/2021 | Pedemonte | H01H 9/04 |

* cited by examiner

UNDERWATER DEVICE WITH ROTARY SWITCH AND RELATED SWITCH ASSEMBLY AND METHOD

TECHNICAL FIELD

The present disclosure relates to the field of electronic components, and, more particularly, to a switching device and related methods.

BACKGROUND

Switches are common electrical components, and provide a fundamental function: selectively closing and opening an electrical connection between two or more points. On the macro scale, the switch typically connects an electrical device (e.g. a light source, a motor, or electronic circuitry) and a power source.

Given the electrical purpose of the switch, the deployment of the device in harsh environments can be problematic. For example, in outdoor applications, debris and moisture can work their way into the switch and cause unreliable operation. In some applications, the switch is submerged in a liquid, such as water. In these applications, the submerged switch may need to be hardened to resist environmental intrusion. This may be especially of interest for a rotary switch where an environmental seal that accommodates submerged rotary motion is typically used.

One approach to this submerged environment for a rotary switch is provided by the Model 1811-100 rotary switch, as available from the Hydracon Company, Inc. of Anaheim, Calif. This rotary switch comprises a plurality of O-ring seals to provide protection from the submerged environment.

SUMMARY

Generally, an underwater device may include a waterproof housing defining a dry cavity therein and comprising a nonferrous switch interface wall. The underwater device may include a rotary switch within the dry cavity and comprising a switch body, and a switch shaft extending outwardly from the switch body. The underwater device may include a first magnetic body within the dry cavity and coupled between the switch shaft and the nonferrous switch interface wall, and a second magnetic body external from the waterproof housing and adjacent the nonferrous switch interface wall in alignment with the first magnetic body so that rotation of the second magnetic body rotates the switch shaft. Each of the first magnetic body and the second magnetic body may comprise a permanent magnet.

Also, the underwater device may include a cap coupled to the second magnetic body. The underwater device may include a detent feature defined between the waterproof housing and the cap. The underwater device may include a retainer coupling the second magnetic body to the waterproof housing.

More specifically, the waterproof housing may define a first recess adjacent the nonferrous switch interface wall rotatably receiving the first magnetic body therein. The waterproof housing may define a second recess adjacent the nonferrous switch interface wall rotatably receiving the second magnetic body therein.

The underwater device may include a switch retainer coupling the rotary switch to the waterproof housing. The waterproof housing may be devoid of a penetration associated with the first and second magnetic bodies. The underwater device may include an electrical device coupled to the rotary switch. In some embodiments, the nonferrous switch interface wall may comprise a flat wall. Also, in particular, the first and second magnetic bodies may abut the nonferrous switch interface wall. The waterproof housing may comprise a first rim defining a first recess, the first magnetic body being within the first rim, and a second ridge defining a second recess, the second magnetic body being within the second ridge. The first rim may surround and abut the first magnetic body.

Another aspect is directed to a switch assembly for an underwater device comprising a waterproof housing defining a dry cavity therein and comprising a nonferrous switch interface wall. The switch assembly may comprise a rotary switch to be positioned within the dry cavity and comprising a switch body, and a switch shaft extending outwardly from the switch body. The switch assembly may comprise a first magnetic body to be positioned within the dry cavity and coupled between the switch shaft and the nonferrous switch interface wall. The switch assembly may further include a second magnetic body to be positioned external from the waterproof housing and adjacent the nonferrous switch interface wall in alignment with the first magnetic body so that rotation of the second magnetic body rotates the switch shaft. Each of the first magnetic body and the second magnetic body may comprise a permanent magnet.

Yet another aspect is directed to a method for making an underwater device. The method may comprise forming a waterproof housing defining a dry cavity therein and comprising a nonferrous switch interface wall. The method may further include coupling a rotary switch within the dry cavity, the rotary switch comprising a switch body, and a switch shaft extending outwardly from the switch body. The method may comprise coupling a first magnetic body within the dry cavity and between the switch shaft and the nonferrous switch interface wall, and coupling a second magnetic body external from the waterproof housing and adjacent the nonferrous switch interface wall in alignment with the first magnetic body so that rotation of the second magnetic body rotates the switch shaft. Each of the first magnetic body and the second magnetic body may comprise a permanent magnet.

DETAILED DESCRIPTION

Figure 1:
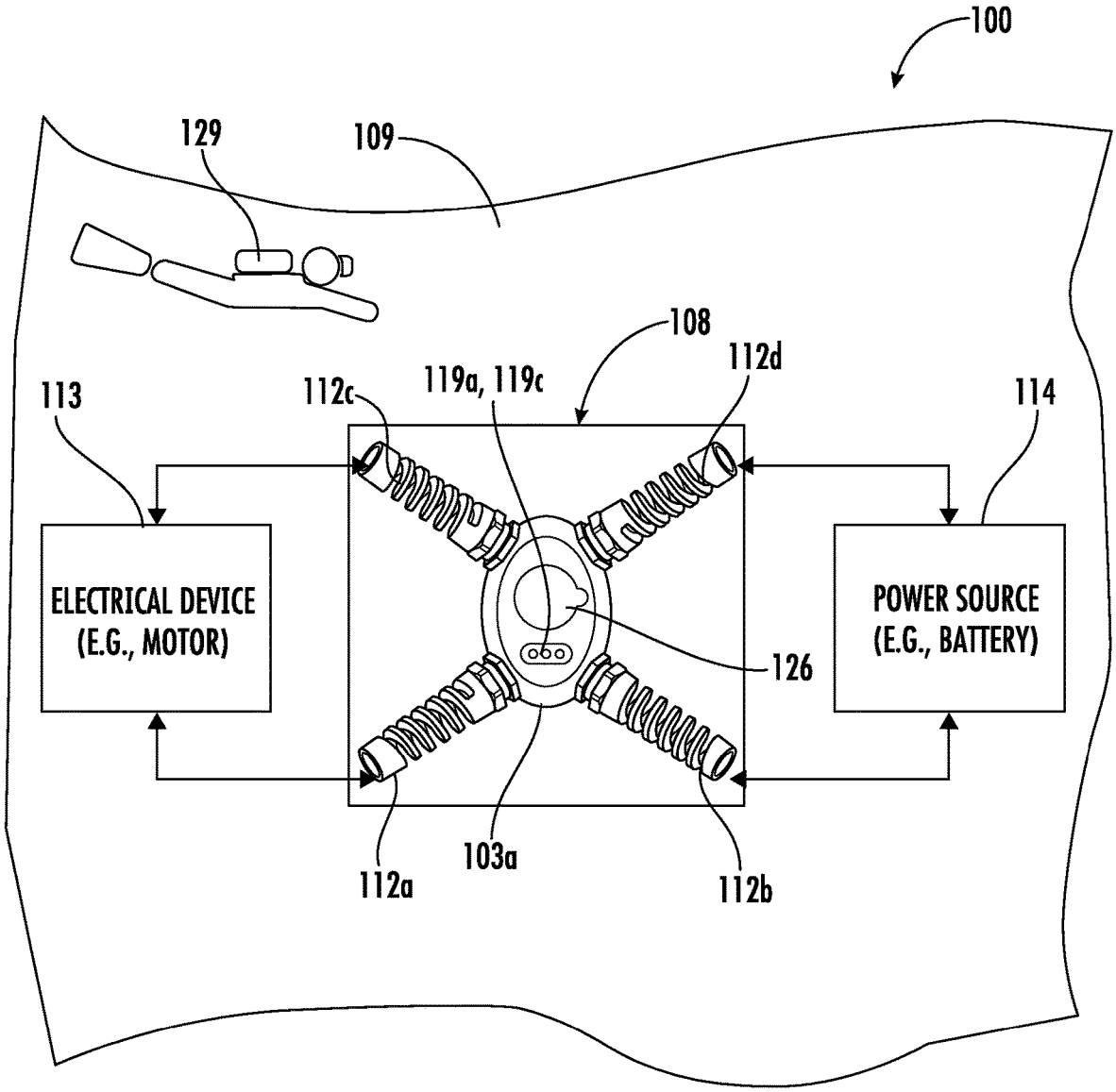
FIG. 1 is a schematic diagram of a first embodiment of an underwater device, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

The typical rotary switch for submerged applications may have some drawbacks. In particular, these typical approaches may be complicated and expensive to manufacture. Moreover, the use of rotating shafts and one or more O-rings introduces a failure point. In light of the prior art, it may be helpful to provide a switch assembly for submerged applications that is inexpensive to manufacture and reliable.

Figure 2:
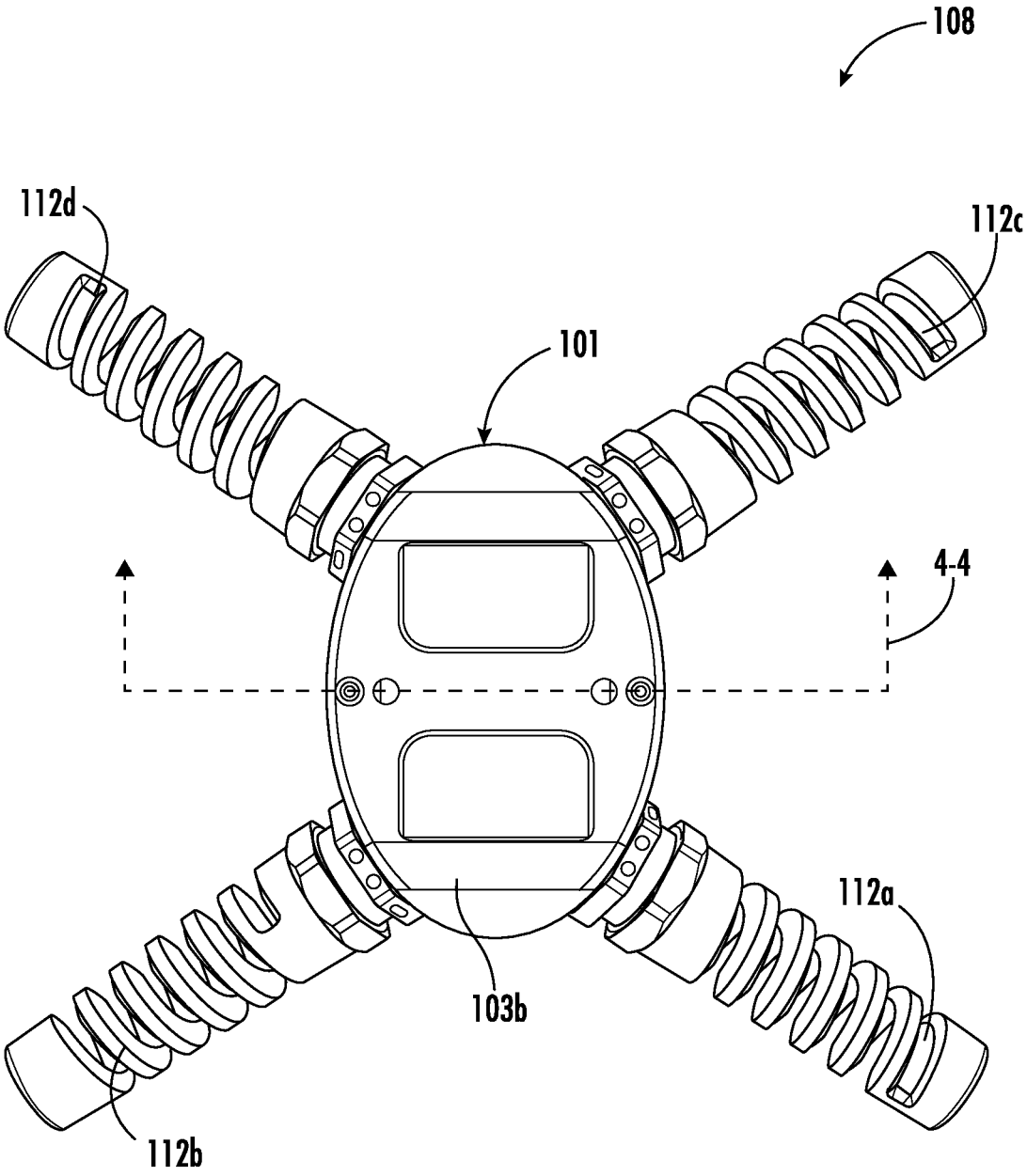
FIG. 2 is a schematic bottom plan view of the switch assembly from the underwater device of FIG. 1.

Referring now to FIGS. 1-2, an underwater device 100 according to the present disclosure is now described. The underwater device 100 may provide an approach to the drawbacks of typical rotary switch for submerged applications. The underwater device 100 is submerged within water 109 and illustratively includes an electrical device 113 (e.g. motor, lighting device, transducer), a power source 114 (e.g. battery), and a switch assembly 108 coupled between the electrical device and the power source.

The switch assembly 108 illustratively includes a waterproof housing 101 defining a dry cavity 102 therein. For example, the dry cavity 102 may be hermetically sealed from the external environment. In some embodiments, the seal of the dry cavity 102 may be to level less than or greater than hermetic. The waterproof housing 101 may comprise a rigid material with enough mechanical strength to resist pressures in any submerged application. For example, the submerged application may comprise a deep water application (e.g. pressure of 200 psi at approximately 150 meters of depth), and the rigid material may comprise stainless steel, or a resin.

The waterproof housing 101 illustratively comprises a first housing section 103*a* (front facing side), a second housing section 103*b* (rear facing side), and a plurality of fasteners 104*a*-104*b* coupled the first housing section and the second housing section together. In some applications, the second housing section 103*b* may be mounted onto a device being controlled. The first housing section 103*a* comprises a flanged rim 105 extending inwardly from a medial section, and a nonferrous switch interface wall 106 within the flanged rim. The first housing section 103*a* comprises an annular wall 107, and the annular wall and the flanged rim define an annular recess 110, which is part of the dry cavity 102.

Figure 3:
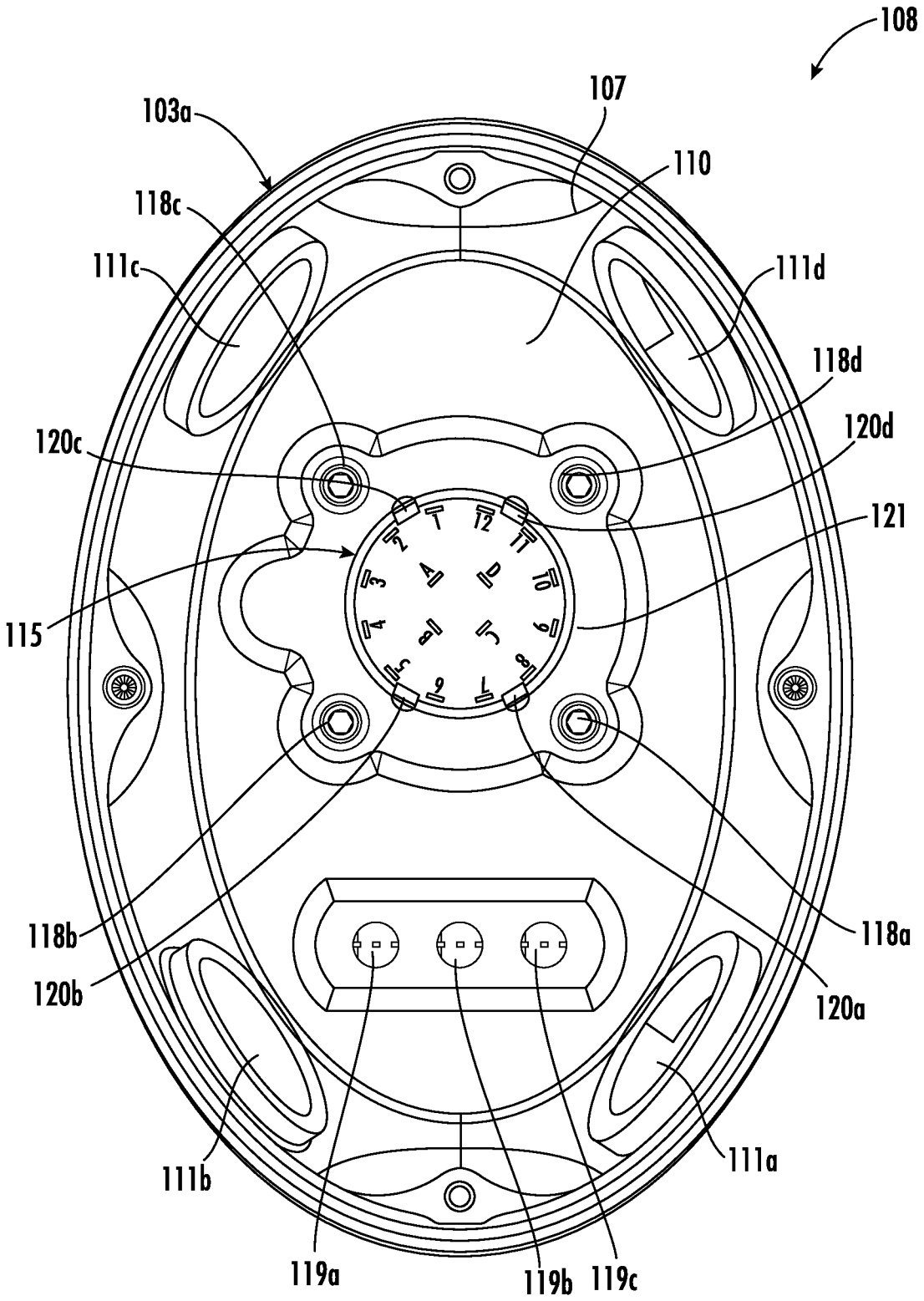
FIG. 3 is a schematic bottom plan view of the switch assembly from the underwater device of FIG. 1 with the second housing section removed.

Referring now additionally to FIG. 3, the first housing section 103*a* also defines a plurality of openings 111*a*-111*d*. The switch assembly 108 illustratively includes a plurality of wire couplers 112*a*-112*d* respectively coupled to the plurality of openings 111*a*-111*d*. This coupling is accomplished via a waterproof adhesive material, for example, a potting material, or a thermoplastic material, or without adhesive material using an O-ring sealed cable receptacle.

The switch assembly 108 illustratively includes a rotary switch 115 within the dry cavity 102 and coupled between the electrical device 113 and the power source 114. The rotary switch 115 illustratively comprises a switch body 116, a switch shaft 117 extending outwardly from the switch body, and a plurality of connection terminals 120*a*-120*d* carried by the switch body. The switch assembly 108 illustratively includes a plurality of visual indicators 119*a*-119*c* carried by the first housing section 103*a* and for indicating a state of the rotary switch 115.

In this illustrated embodiment, the number of connection terminals 120*a*-120*d* and wire couplers 112*a*-112*d* is four (i.e. a 3 position rotary switch with 4 poles), but this is merely exemplary, and other configurations are possible in differing embodiments. The switch assembly 108 includes a switch retainer 121 coupling the rotary switch 115 to the waterproof housing 101 via a plurality of fasteners 118*a*-118*d*.

Figure 4:
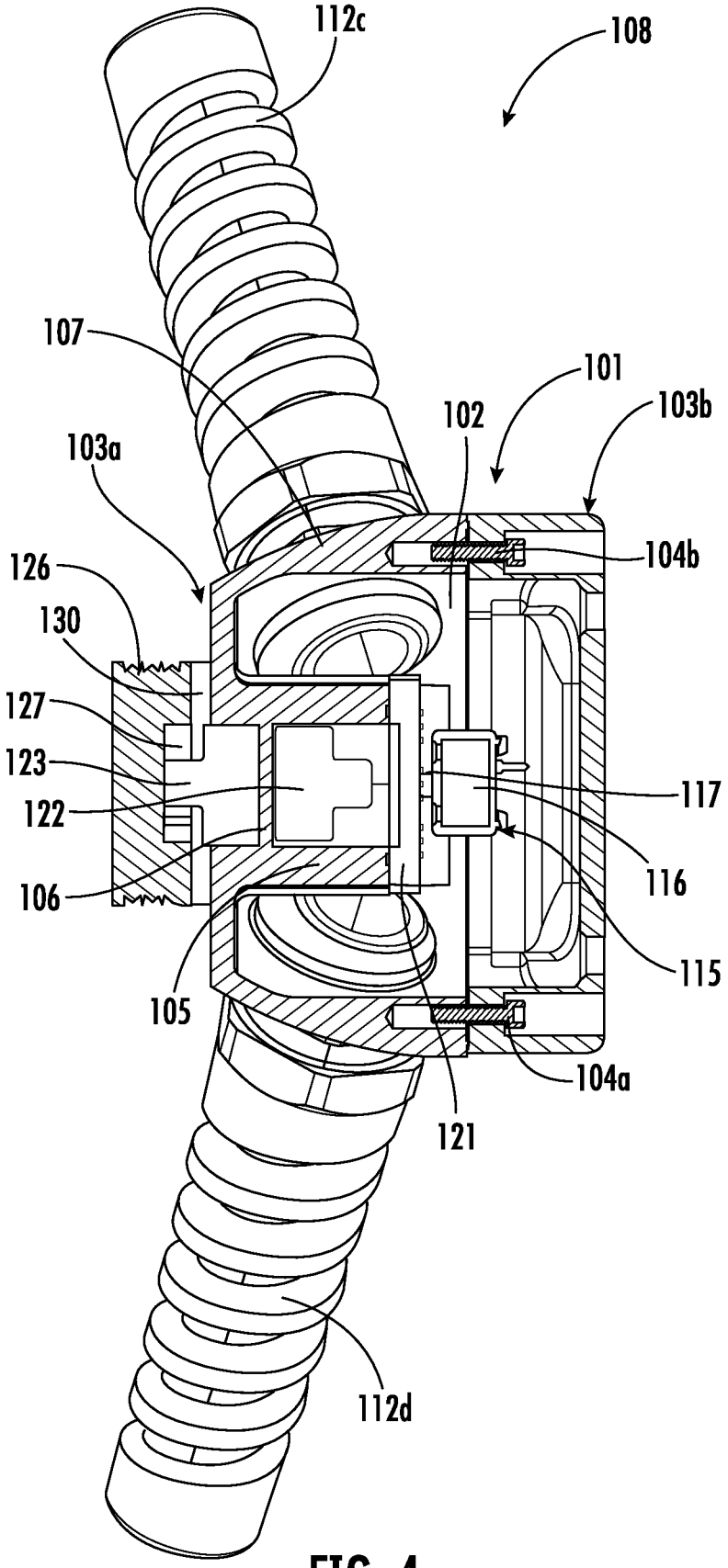
FIG. 4 is a schematic cross-section view of the switch assembly of FIG. 2 along line 4-4.

Referring now additionally to FIG. 4, the switch assembly 108 illustratively includes a first magnetic body 122 within the dry cavity 102 and coupled between the switch shaft 117 and the nonferrous switch interface wall 106, and a second magnetic body 123 external from the first housing section 103*a* of the waterproof housing 101 and adjacent the nonferrous switch interface wall in alignment with the first magnetic body so that rotation of the second magnetic body rotates the switch shaft. As shown, the first magnetic body 122 and the second magnetic body 123 are aligned with each other and each abuts opposite sides of the nonferrous switch interface wall 106. Each of the first magnetic body 122 and the second magnetic body 123 is substantially cylinder-shaped and comprises a cylinder-shaped body, and a shaft extending outward therefrom.

In the illustrated embodiment, both of the first magnetic body 122 and the second magnetic body 123 may each comprise a magnet (i.e. oriented so that the poles are inverted for an attraction magnetic force). For example, the magnet may comprise a permanent magnet.

Figure 5:
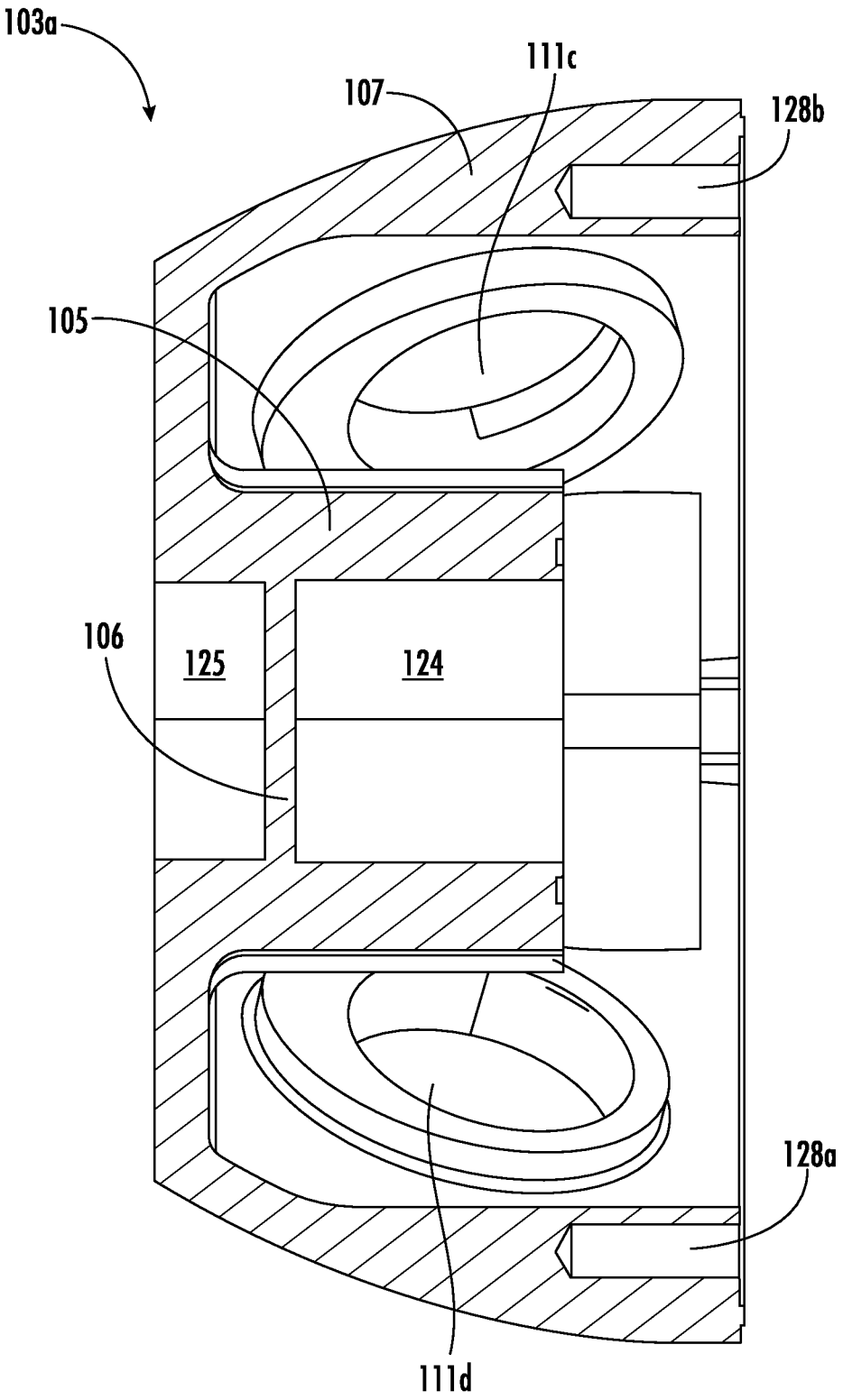
FIG. 5 is a schematic cross-section view of the first housing section from the switch assembly of FIG. 2 along line 4-4.

Referring now additionally to FIG. 5, the first housing section 103*a* of the waterproof housing 101 defines a first recess 124 adjacent the nonferrous switch interface wall 106 rotatably receiving the first magnetic body 122 therein. The first housing section 103*a* of the waterproof housing 101 defines a second recess 125 adjacent the nonferrous switch interface wall 106 rotatably receiving the second magnetic body 123 therein. Also, the first housing section 103*a* defines a plurality of fastener receiving passageways 128*a*-128*b* receiving the plurality of fasteners 104*a*-104*b*. The nonferrous switch interface wall 106 illustratively comprises a flat wall with uniform thickness extending between the first recess 124 and the second recess 125. In other embodiments (FIG. 7), the nonferrous switch interface wall 106 may comprise a non-planar shape with varying thickness. Of course, the magnetic coupling between the first magnetic body 122 and the second magnetic body 123 is limited by the separation distance therebetween. While any arbitrary shape is possible for the nonferrous switch interface wall 106, flat surfaces and curves that minimize the separation distance may be desirable.

The switch assembly 108 illustratively includes a cap 126 coupled to the second magnetic body 123. The cap 126 also defines a cap cavity 127 therein receiving the shaft of the second magnetic body 123. More specifically, the cap 126 is coupled to the second magnetic body 123 via a fixation feature (i.e. fixing at least the rotational positioning between the cap and the second magnetic body). For example, the fixation feature may comprise a set screw (FIG. 6), or an adhesive bonding. As will be appreciated, the cap 126 is manipulated by a user 129 to control a state of the rotary switch 115.

The switch assembly 108 may include a retainer 130 coupling the second magnetic body 123 to the first housing section 103*a* of the waterproof housing 101. Although not shown, the retainer 130 is coupled to the first housing section 103*a* via a plurality of fasteners. Helpfully, this retainer 130 is not waterproof and permits fluid to surround the second magnetic body 123 and enter the cap cavity 127. For deep water applications where water pressure is relatively high, this permits pressure equalization and provides for easy movement of the cap 126 by the user 129. Also, the retainer 130 may include a stop portion for limiting the rotational movement of the cap, thereby preventing unintended reverse polarity operations.

In some embodiments, the cap 126 may be readily removed to provide for a hidden switch. In other words, the authorized user 129 may carry the cap 126 and install it on the exposed shaft of the second magnetic body 123 extending through the retainer 130.

Helpfully, in the switch assembly 108, magnetics are used to transfer torque over a gap. The waterproof housing 101 may be devoid of a penetration associated with the first magnetic body 122 and the second magnetic body 123. Since these bodies rotate during normal use, the lack of penetrations may improve reliability. Moreover, the complex rotating O-ring design of the typical rotary switch is avoided, which reduces costs. Also, the switch assembly 108 has a small physical profile, in contrast to the bulky typical switches.

Another aspect is directed to a switch assembly 108 for an underwater device 100 comprising a waterproof housing 101 defining a dry cavity 102 therein and comprising a nonferrous switch interface wall 106. The switch assembly 108 comprises a rotary switch 115 to be positioned within the dry cavity 102 and comprising a switch body 116, and a switch shaft 117 extending outwardly from the switch body, and a first magnetic body 122 to be positioned within the dry cavity 102 and coupled between the switch shaft and the nonferrous switch interface wall 106. The switch assembly 108 further includes a second magnetic body 123 to be positioned external from the waterproof housing 101 and adjacent the nonferrous switch interface wall 106 in alignment with the first magnetic body 122 so that rotation of the second magnetic body rotates the switch shaft.

Yet another aspect is directed to a method for making an underwater device 100. The method comprises forming a waterproof housing 101 defining a dry cavity 102 therein and comprising a nonferrous switch interface wall 106. The method comprises coupling a rotary switch 115 within the dry cavity 102, the rotary switch comprising a switch body 116, and a switch shaft 117 extending outwardly from the switch body. The method comprises coupling a first magnetic body 122 within the dry cavity 102 and between the switch shaft 117 and the nonferrous switch interface wall 106, and coupling a second magnetic body 123 external from the waterproof housing 101 and adjacent the nonferrous switch interface wall in alignment with the first magnetic body so that rotation of the second magnetic body rotates the switch shaft 117.

Figure 6:
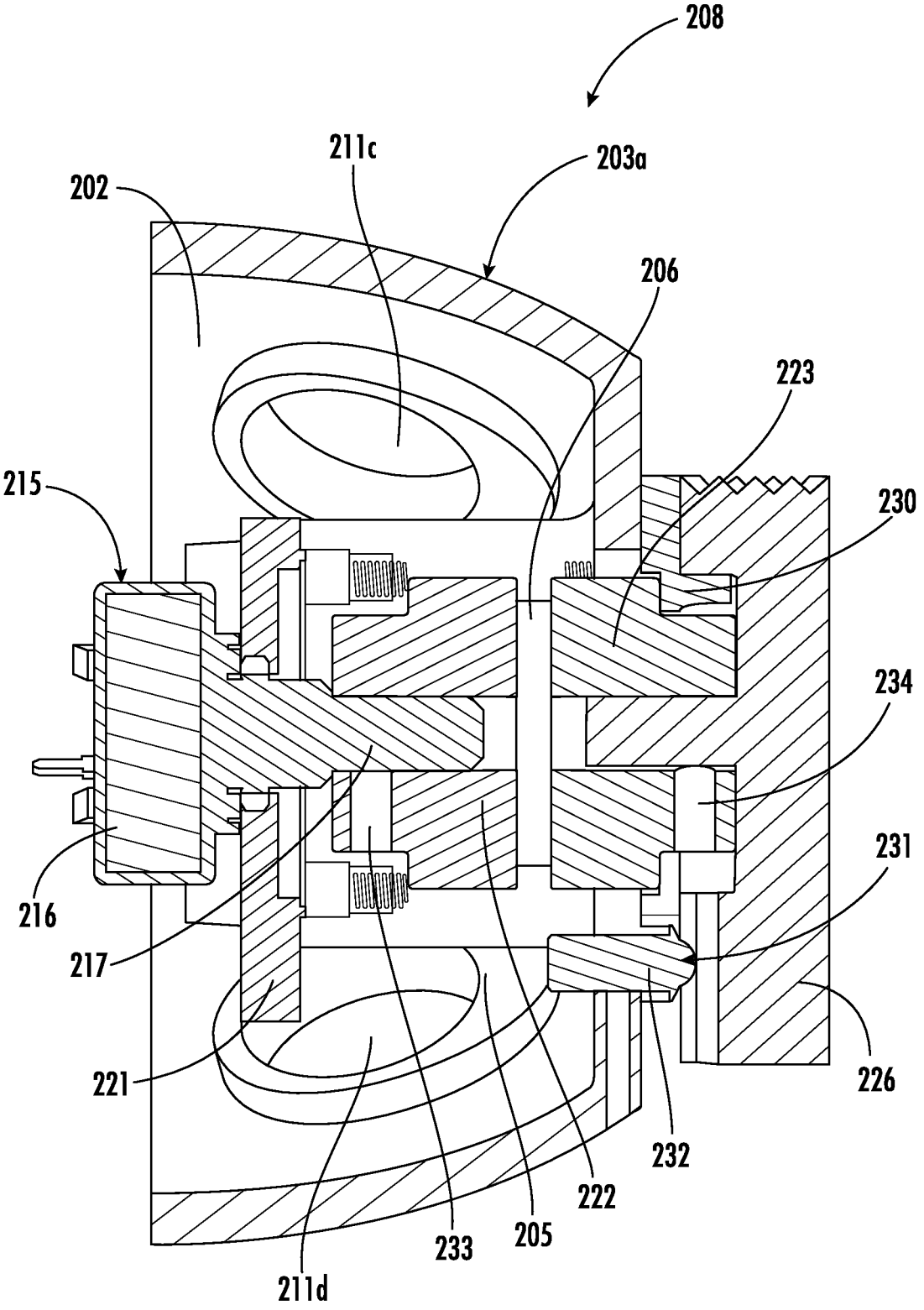
FIG. 6 is a schematic cross-section view of a second embodiment of the switch assembly from the underwater device of FIG. 2 along line 4-4.

Referring now additionally to FIG. 6, another embodiment of the switch assembly 208 is now described. In this embodiment of the switch assembly 208, those elements already discussed above with respect to FIGS. 1-5 are incremented by 100 and most require no further discussion herein. This embodiment differs from the previous embodiment in that this switch assembly 208 illustratively includes a detent feature 231 defined between the waterproof housing 201 and the cap 226. The detent feature 231 illustratively comprises a set pin 232 carried by the waterproof housing 201, and an elastic device (e.g. a spring) configured to bias the pin to abut the cap 226. Helpfully, the detent feature 231 may provide for haptic feedback when the cap 226 is rotated.

Also, each of the first magnetic body 222 and the second magnetic body 223 respectively defines a radially extending passageway 233, 234 for receiving a fastener. The fasteners couple the switch shaft 217 to the first magnetic body 222, and the cap 226 to the second magnetic body 223.

Figure 7:
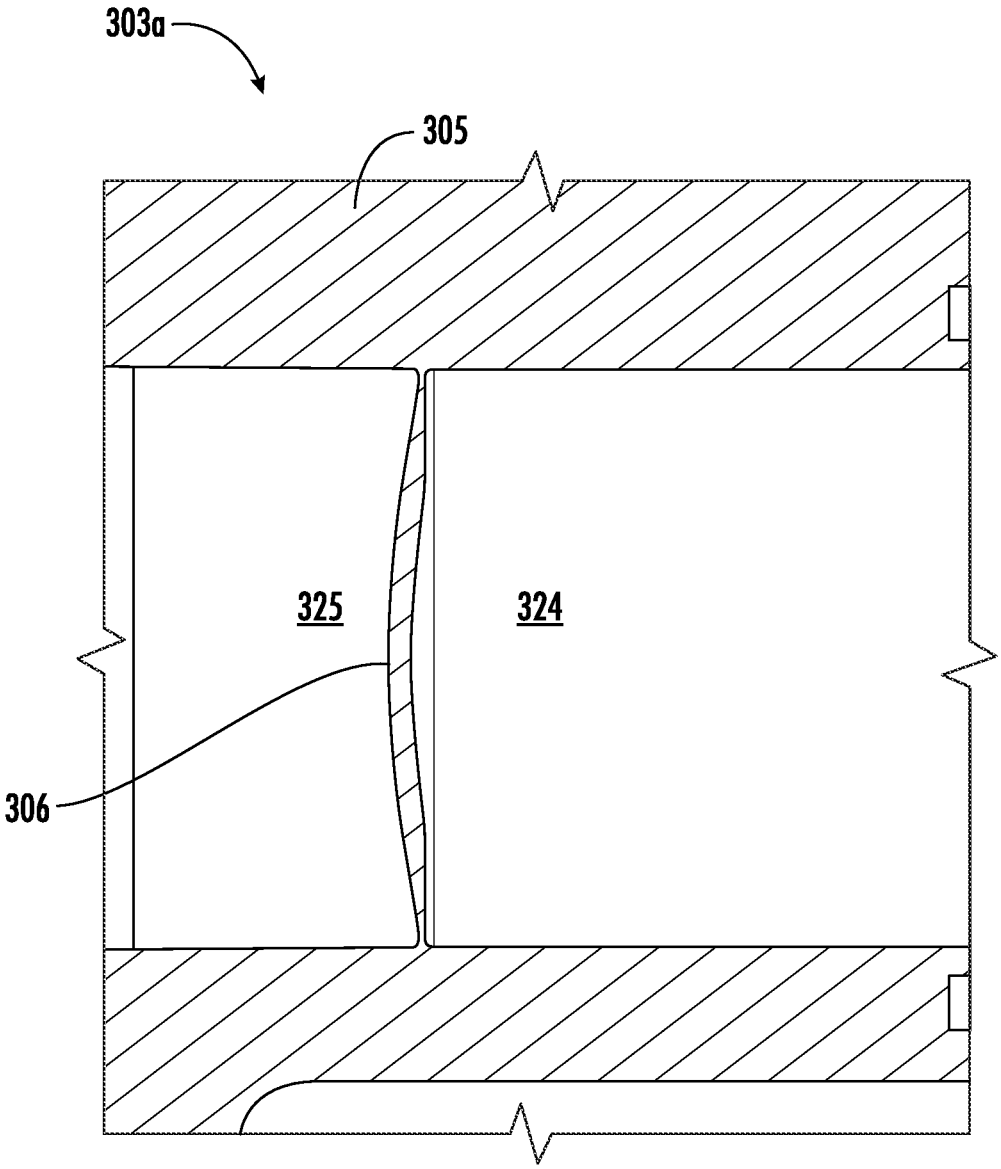
FIG. 7 is a partial schematic cross-section view of a third embodiment of the switch assembly from the underwater device of FIG. 2 along line 4-4.

Referring now additionally to FIG. 7, another embodiment of the first housing section 303*a* is now described. In this embodiment of the first housing section 303*a*, those elements already discussed above with respect to FIGS. 1-5 are incremented by 200 and most require no further discussion herein. This embodiment differs from the previous embodiment in that this first housing section 303*a* illustratively includes a nonferrous switch interface wall 306 having a curved shape. In particular, the nonferrous switch interface wall 306 is convex towards the external water side, which helpfully resists high pressure forces more readily.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. An underwater device comprising:

a waterproof housing defining a dry cavity therein and comprising a nonferrous switch interface wall, the waterproof housing comprising a first rim defining a first recess, and a second ridge defining a second recess, the first and second recesses being adjacent respective opposite first and second sides of the nonferrous switch interface wall;

a rotary switch within the dry cavity and comprising a switch body, and a switch shaft extending outwardly from the switch body, the switch shaft having an axis and being rotated about the axis during operation of the rotary switch;

a first magnetic body rotatably positioned within the first recess of the waterproof housing, within the dry cavity, and coupled between the switch shaft and the nonferrous switch interface wall, the first magnetic body abutting the nonferrous switch interface wall and being within the first rim; and a second magnetic body rotatably positioned within the second recess of the waterproof housing, external from the waterproof housing, and adjacent the nonferrous switch interface wall in alignment with the first magnetic body so that rotation of the second magnetic body rotates the switch shaft, the second magnetic body abutting the nonferrous switch interface wall and being within the second ridge;

each of the first magnetic body and the second magnetic body comprising a permanent magnet.

2. The underwater device of claim 1 comprising a cap coupled to the second magnetic body.

3. The underwater device of claim 2 comprising a detent feature defined between the waterproof housing and the cap.

4. The underwater device of claim 2 comprising a retainer coupling the second magnetic body to the waterproof housing.

5. The underwater device of claim 1 comprising a switch retainer coupling the rotary switch to the waterproof housing.

6. The underwater device of claim 1 wherein the waterproof housing is devoid of a penetration associated with the first and second magnetic bodies.

7. The underwater device of claim 1 comprising an electrical device coupled to the rotary switch.

8. The underwater device of claim 1 wherein the nonferrous switch interface wall comprises a flat wall.

9. The underwater device of claim 1 wherein the first rim surrounds and abuts the first magnetic body.

10. A switch assembly for an underwater device comprising a waterproof housing defining a dry cavity therein and comprising a nonferrous switch interface wall, the waterproof housing comprising a first rim defining a first recess, and a second ridge defining a second recess, the first and second recesses being adjacent respective opposite first and second sides of the nonferrous switch interface wall, the switch assembly comprising:

a rotary switch to be positioned within the dry cavity and comprising a switch body, and a switch shaft extending outwardly from the switch body, the switch shaft having an axis and being rotated about the axis during operation of the rotary switch;

a first magnetic body to be rotatably positioned within the first recess of the waterproof housing, within the dry cavity, and coupled between the switch shaft and the nonferrous switch interface wall, the first magnetic body abutting the nonferrous switch interface wall and being within the first rim; and a second magnetic body to be rotatably positioned within the second recess of the waterproof housing, external from the waterproof housing, and adjacent the nonferrous switch interface wall in alignment with the first magnetic body so that rotation of the second magnetic body rotates the switch shaft, the second magnetic body abutting the nonferrous switch interface wall and being within the second ridge;

each of the first magnetic body and the second magnetic body comprising a permanent magnet.

11. The switch assembly of claim 10 comprising a cap coupled to the second magnetic body.

12. The switch assembly of claim 11 comprising a detent feature defined between the waterproof housing and the cap.

13. The switch assembly of claim 11 comprising a retainer coupling the second magnetic body to the waterproof housing.

14. The switch assembly of claim 10 comprising a switch retainer coupling the rotary switch to the waterproof housing.

15. The switch assembly of claim 10 wherein the nonferrous switch interface wall comprises a flat wall.

16. The switch assembly of claim 10 wherein the first rim surrounds and abuts the first magnetic body.

17. A method for making an underwater device, the method comprising:

forming a waterproof housing defining a dry cavity therein and comprising a nonferrous switch interface wall, the waterproof housing comprising a first rim defining a first recess, and a second ridge defining a second recess, the first and second recesses being adjacent respective opposite first and second sides of the nonferrous switch interface wall;

coupling a rotary switch within the dry cavity, the rotary switch comprising a switch body, and a switch shaft extending outwardly from the switch body, the switch shaft having an axis and being rotated about the axis during operation of the rotary switch;

coupling a first magnetic body to be rotatably positioned within the first recess of the waterproof housing, within the dry cavity, and between the switch shaft and the nonferrous switch interface wall, the first magnetic body abutting the nonferrous switch interface wall and being within the first rim; and coupling a second magnetic body to be rotatably positioned within the second recess of the waterproof housing, external from the waterproof housing, and adjacent the nonferrous switch interface wall in alignment with the first magnetic body so that rotation of the second magnetic body rotates the switch shaft, the second magnetic body abutting the nonferrous switch interface wall and being within the second ridge;

each of the first magnetic body and the second magnetic body comprises a permanent magnet.

18. The method of claim 17 comprising coupling a cap to the second magnetic body.

19. The method of claim 18 comprising coupling a detent feature defined between the waterproof housing and the cap.

20. The method of claim 17 comprising coupling the second magnetic body to the waterproof housing with a retainer.

* * * * *